US011348563B2

(12) United States Patent
Baggs et al.

(10) Patent No.: US 11,348,563 B2
(45) Date of Patent: May 31, 2022

(54) PICKUP SADDLES FOR STRINGED INSTRUMENTS UTILIZING INTERFERENCE FIT

(71) Applicant: Lloyd Baggs Innovations, LLC, Nipomo, CA (US)

(72) Inventors: Lloyd R. Baggs, Nipomo, CA (US); Robert Radis, Nipomo, CA (US); Daniel Baggs, Arroyo Grande, CA (US); Thomas Linn, Nipomo, CA (US)

(73) Assignee: Lloyd Baggs Innovations, LLC, Nipomo, CA (US)

( * ) Notice: Subject to any disclaimer, the term of this patent is extended or adjusted under 35 U.S.C. 154(b) by 0 days.

(21) Appl. No.: 16/825,819

(22) Filed: Mar. 20, 2020

(65) Prior Publication Data

US 2020/0302904 A1 Sep. 24, 2020

Related U.S. Application Data

(60) Provisional application No. 62/821,346, filed on Mar. 20, 2019.

(51) Int. Cl.

| | |
|---|---|
| ***G10H 3/18*** | (2006.01) |
| ***G10H 3/00*** | (2006.01) |
| ***G10D 3/04*** | (2020.01) |
| ***G10D 3/12*** | (2020.01) |
| ***G10D 3/14*** | (2020.01) |

(52) U.S. Cl.

CPC ..... *G10H 3/185* (2013.01); *G10D 3/04* (2013.01); *G10D 3/12* (2013.01); *G10D 3/14* (2013.01); *G10H 3/00* (2013.01)

(58) Field of Classification Search

CPC ..... G10H 3/185; G10H 3/00; G10D 3/04; G10D 3/12; G10D 3/14

USPC ..... 84/307

See application file for complete search history.

(56) References Cited

U.S. PATENT DOCUMENTS

| | | | |
|---|---|---|---|
| 2,324,024 | A | 7/1943 | Ream |
| 2,420,864 | A | 5/1947 | Constantin |
| 2,456,995 | A | 12/1948 | Robinson |
| 2,769,867 | A | 11/1956 | Crownover et al. |
| 3,070,775 | A | 12/1962 | Andrews, Jr. |
| 3,291,887 | A | 12/1966 | Carman et al. |
| 3,325,580 | A | 6/1967 | Barcus et al. |
| 3,538,232 | A | 11/1970 | Bachtig et al. |
| 3,600,497 | A | 8/1971 | Zanessi |
| 3,712,951 | A | 1/1973 | Rickard |

(Continued)

FOREIGN PATENT DOCUMENTS

| | | |
|---|---|---|
| DE | 3100326 C2 | 11/1984 |
| DE | 3402463 C1 | 6/1985 |
| DE | 3536921 A1 | 4/1987 |

*Primary Examiner* — Christina M Schreiber
(74) *Attorney, Agent, or Firm* — KPPB LLP

(57) ABSTRACT

In several embodiments of the invention, a pickup saddle for a stringed instrument includes a U-shaped top cap having two legs, each leg including a receiving portion configured to mate with a mating portion of a base, a base fitted to the interior of the top cap, where two surfaces of the base include a mating portion matching with and affixed to a receiving portion of the top cap, a piezoelectric transducer placed between the top cap and the base and electrically connected to the base, a positive wire connected to the piezoelectric transducer, and a ground wire connected to the base.

10 Claims, 10 Drawing Sheets

(56) References Cited

U.S. PATENT DOCUMENTS 3,725,561 A 4/1973 Paul
3,792,204 A 2/1974 Murayama et al.
3,858,480 A 1/1975 Schneider et al.
4,135,426 A 1/1979 Rickard
4,147,084 A 4/1979 Underwood
4,160,401 A * 7/1979 Tomioka ..... G10D 3/14 84/731
4,189,969 A * 2/1980 Katayama ..... G10H 3/185 84/731
4,230,013 A * 10/1980 Wellings ..... G10H 3/14 361/283.1
4,278,000 A 7/1981 Saito et al.
4,290,331 A 9/1981 Izdebski
4,314,495 A * 2/1982 Baggs ..... G10H 3/185 84/731
4,356,754 A * 11/1982 Fishman ..... G10H 3/185 84/731
4,491,051 A * 1/1985 Barcus ..... G10H 3/143 84/728
4,501,186 A 2/1985 Ikuma
4,514,247 A 4/1985 Zola
4,580,480 A 4/1986 Turner
4,581,974 A 4/1986 Fender
4,581,975 A 4/1986 Fender
4,633,121 A 12/1986 Ogawa et al.
4,634,917 A 1/1987 Dvorsky et al.
4,657,114 A * 4/1987 Shaw ..... G10H 3/185 84/731
4,688,460 A 8/1987 McCoy
4,727,634 A 3/1988 Fishman
4,774,867 A 10/1988 Fishman
4,785,704 A * 11/1988 Fishman ..... G10H 3/185 84/731
4,815,353 A 3/1989 Christian
4,944,209 A 7/1990 Fishman
4,975,616 A 12/1990 Park
5,012,086 A 4/1991 Barnard
5,027,691 A 7/1991 Kennedy
5,029,375 A 7/1991 Fishman
5,155,285 A 10/1992 Fishman
5,168,117 A 12/1992 Anderson
5,189,771 A 3/1993 Fishman
5,218,159 A * 6/1993 McClish ..... G10H 3/185 84/731
5,319,153 A * 6/1994 Fishman ..... G10H 3/185 310/340
5,322,969 A * 6/1994 Aaroe ..... G10H 3/185 84/731
5,410,101 A * 4/1995 Sakurai ..... G10H 3/185 84/731
5,455,381 A * 10/1995 Juszkiewicz ..... G10D 3/04 84/727
5,463,185 A 10/1995 Fishman
5,539,147 A * 7/1996 Hoshino ..... G10H 3/185 84/723
5,670,733 A 9/1997 Fishman
5,817,966 A * 10/1998 Fishman ..... G10H 3/185 84/731
6,023,019 A 2/2000 Baggs
6,078,006 A * 6/2000 Raisanen ..... G10H 3/185 84/723
6,336,367 B1 * 1/2002 Raisanen ..... G10H 3/185 73/632
6,605,771 B1 * 8/2003 Baggs ..... G10H 3/146 84/723
6,822,156 B1 11/2004 Lazarus et al.
7,135,638 B2 11/2006 Garrett et al.
7,157,640 B2 * 1/2007 Baggs ..... G10H 3/185 84/731
7,943,838 B2 * 5/2011 Dunwoodie ..... G10H 3/185 84/298
8,969,702 B2 * 3/2015 Takabayashi ..... G10H 3/143 84/730
9,796,065 B2 * 10/2017 Urban ..... B25B 1/103
10,636,403 B2 * 4/2020 Clark ..... G10H 3/185
10,991,353 B1 * 4/2021 Baker ..... G10H 3/181
2004/0134328 A1 * 7/2004 Yeakel ..... G10H 3/183 84/298
2004/0159224 A1 * 8/2004 Raisanen ..... G10H 3/185 84/730
2004/0255763 A1 * 12/2004 Baggs ..... G10H 3/185 84/731
2005/0109197 A1 5/2005 Garrett et al.
2010/0307324 A1 * 12/2010 Takabayashi ..... G10H 3/185 84/731
2012/0103171 A1 * 5/2012 Lashbrook ..... G10D 3/04 84/731
2013/0019736 A1 * 1/2013 Finkle ..... G10D 3/04 84/313
2019/0348017 A1 * 11/2019 Clark ..... G10H 3/185
2020/0302904 A1 * 9/2020 Baggs ..... G10D 1/085

* cited by examiner

PICKUP SADDLES FOR STRINGED INSTRUMENTS UTILIZING INTERFERENCE FIT

RELATED APPLICATIONS

The present application claims priority under 35 U.S.C. 119(e) to U.S. Patent Application No. 62/821,346, filed Mar. 20, 2019, the disclosure of which is incorporated by reference in its entirety.

FIELD OF THE INVENTION

The present invention relates generally to stringed musical instrument pickups and more specifically to improved design of pickup saddles.

BACKGROUND OF THE INVENTION

Stringed musical instruments, such as guitars, violins, basses (guitar and upright), etc., typically include a set of strings that are struck or manipulated in some way and thereby produce sound as they vibrate. In some instruments the strings run over a saddle which provides an endpoint. Saddles can be provided for individual strings or for multiple strings. An electromechanical transducer can be placed underneath a saddle as a pickup to generate a signal from the vibrational energy of the contacting string. Many conventional pickup saddles follow a design such as that disclosed in U.S. Pat. No. 5,218,159 to McClish (the McClish patent). A pickup saddle such as one in the McClish patent is illustrated in FIG. 1. The pickup includes a top cap that is crimped to the body of the saddle so that a piezoelectric transducer is held in place between the top cap and the body.

SUMMARY OF THE INVENTION

Pickup saddles for stringed instruments utilizing interference fit in accordance with embodiments of the invention are disclosed. In several embodiments, a pickup saddle for a stringed instrument includes a U-shaped top cap having two legs, each leg including a receiving portion configured to mate with a mating portion of a base, a base fitted to the interior of the top cap, where two surfaces of the base include a mating portion matching with and affixed to a receiving portion of the top cap, a piezoelectric transducer placed between the top cap and the base and electrically connected to the base, a positive wire connected to the piezoelectric transducer, and a ground wire connected to the base.

The pickup saddle of claim 1, wherein the receiving portion of each leg of the top cap includes a receiving cavity for an interference fit and where each mating portion of the base includes a protrusion for an interference fit formed to fit a corresponding receiving cavity on the top cap.

In additional embodiments, the interference fits are dovetail joints.

In further embodiments, the dovetail joint is tapered toward the top of the pickup saddle.

In several additional embodiments, the pickup saddle also includes a tune-o-matic bridge and at least one other pickup saddle within the tune-o-matic bridge.

In several further embodiments, the bottom surface of the base is convex shaped front-to-back.

In some more embodiments, the pickup saddle also includes at least one additional top cap attached to the base and a piezoelectric transducer under each additional top cap.

In yet additional embodiments, the ground wire is connected to the base by solder.

In further additional embodiments, the piezoelectric transducer is affixed to the underside of the top cap and connected to a positive wire facing downward from the piezoelectric transducer.

In yet more embodiments, the positive wire passes through a hole in the base and exits the underside of the base.

DETAILED DISCLOSURE OF THE INVENTION

Figure 1:
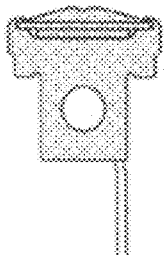
FIG. 1 (Prior Art)
FIG. 1 is a side view diagram of a pickup saddle.

In the course of exploring aspects of embodiments of the invention, it was found that there are at least two primary modes of failure in traditional pickups such as the types disclosed in the McClish patent. First, the positive wire often will detach from the positive electrode of the piezo or the piezo will separate from the string contact. Second, the top cap that holds the piezo to the base often can shear or break loose from the crimps or other retaining mechanisms attempting to hold it in place relative to the piezo and the base due to repeated vibration and/or age weakening the material. Additionally, these types of pickups often exhibit large differences in string-to-string balance because of preload or distortion of the embedded transducer. There can be 6-9 dB difference in signal between sets of binned pickups and/or 3-4 dB of difference between pickups in a set. Some of this is due to the sensitivity of piezo pickups, but also a mechanical preload such as the force of the top cap being crimped to the body will further alter efficiency. A primary cause of many of these issues is the way these types of pickups are assembled. In a typical configuration, the base has two tabs or other retaining mechanisms that wrap around and over the top of the top cap. The tabs are crimped or bent into place to hold down the top cap. Not only does this often impart a preload onto the piezo, it can allow for movement of the top cap and/or separation of the top cap from the base if the crimp fails.

Pickups in accordance with embodiments of the invention can alleviate some of the negative aspects of traditional pickup saddles mentioned above. First, securing the top cap and the base together with a mechanism such as using an interference fit can reduce the mechanical preload on the transducer that can cause large differences in sensitivity as well as the likelihood of the two parts separating from one another. With an interference fit, friction along mating surfaces hold the base to the top cap securely and with minimal potential movement of the two pieces in relation to one another and minimal forces pressing them together. Second, the interference fit is a more reliable mechanical connection which can reduce strain on wires exiting the transducer, thereby reducing the likelihood of breakage. Some other embodiments secure the top cap and the base together with mechanisms (e.g., adhesive, weld, solder, etc.) other than an interference fit that also does not impart a preload to the transducer. Many embodiments include a piezoelectric transducer or other type of electromechanical transducer that provides an electrical signal representative of audio, although one skilled in the art will recognize that other types of transducers may be utilized as appropriate to a particular application.

Construction

In several embodiments, the outer shape and profile of the assembled pickup saddle is similar to a traditional saddle as a generally rectangular prism, although other shapes are possible. A pickup saddle in accordance with many embodiments of the invention includes at least a top cap, a base, and a transducer pickup sensor. A top cap portion of a pickup saddle in accordance with an embodiment of the invention is illustrated in a side view in FIG. 2A and in a bottom view in FIG. 2B.

In several embodiments of the invention, the top surface 12 of the top cap 10 has a string resting surface configured for a string to rest on it, for example with a notch or groove. The groove can have a width that matches the string gauge. A piezoelectric transducer 14 can be placed on the underside of a top cap, for example, within a shallow recess or pocket 16. In many embodiments, the piezoelectric transducer 14 can be affixed in any of a variety of ways, including but not limited to, soldering or conductive epoxy. In some embodiments, the positive terminal of the piezoelectric transducer faces down away from the top of the top cap. In several embodiments, the transducer may fit at least partially within a shallow recess 16 that can help it to stay in place.

In many embodiments, the top cap 10 is U-shaped with mating surfaces on the inner sides of the two "legs" 18, 20 of the "U" to match mating surfaces a base that can be introduced into the inner space of the "U." In several embodiments, the mating surfaces include female mating features 22, 24 that provide an interference fit by forming receiving portions into which protruding male mating features on a base can fit. In various embodiments, the female and male portions can be switched from top cap to base as may be appropriate. In further embodiments, the mating surfaces utilize other fastening mechanisms that place little or no preload onto the transducer enclosed within the pickup saddle, such as adhesive, weld, solder, etc.

In additional embodiments, the top cap can have multiple U's such that it forms a "W" or a comb shape. In such embodiments, a base can be inserted into each U cavity and a string may pass over the top of the top cap at the area opposing each U cavity.

In several embodiments, the inference fit or other fastening mechanism is designed to hold the base in place within the "U" using friction without distorting either the U or base parts or the piezoelectric transducer. In this way, minimal or zero preload is applied to the piezoelectric transducer. As mentioned further above, preload on a piezoelectric transducer can cause high variation in output levels between transducers because the amount of preload is difficult to predict and/or control. Furthermore, the interference fit is a better mechanical connection which can decrease the likelihood of the transducer detaching from the top cap or wires to break due to tension and/or movement.

In some embodiments, the interference fit is provided by a dovetail joint at each of the mating surfaces. In other embodiments, the interference fit is provided by a dowel and rail joint or a T joint. In additional embodiments, the thickness and/or taper of the beam (i.e., male portion of joint) and/or flutes can be tuned to control the resonant frequency. In several embodiments, the joint shape forming the interference fit is slightly tapered toward the top.

The interference fit can also allow the top of the top cap to remain flexible without requiring a crimp to keep the top cap and base together. Any loading on the top would be minimal and consistent.

The interference fit can also provide a strong ground connection and strain relief by reducing degrees of freedom in movement of the top cap relative to the base.

Figure 3A:
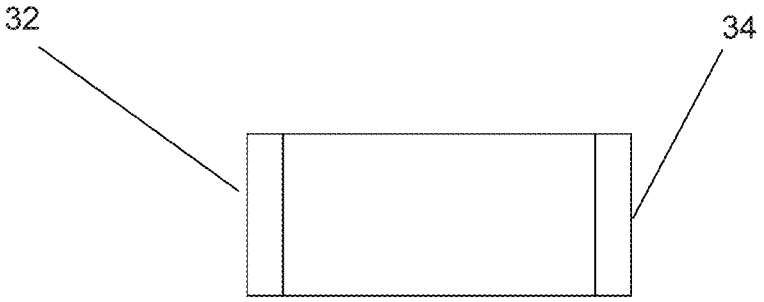
FIG. 3A is a side view diagram illustrating a base of a pickup saddle with interference fit in accordance with an embodiment of the invention.
Figure 3B:
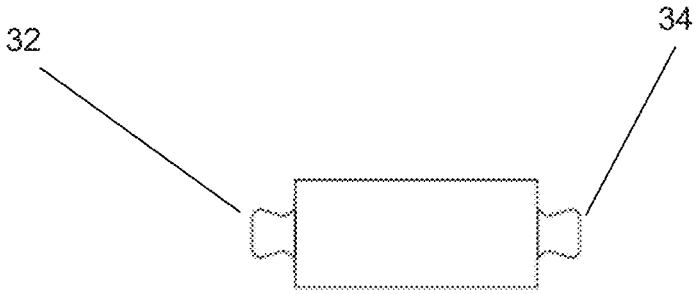
FIG. 3B is a bottom view diagram illustrating a base of a pickup saddle with interference fit in accordance with an embodiment of the invention.

A base portion of a pickup saddle in accordance with an embodiment of the invention is illustrated in a side view in FIG. 3A and in a bottom view in FIG. 3B. The base includes mating surfaces 32, 34 that match the corresponding mating surfaces 22, 24 in the top cap 10. In several embodiments, the mating surfaces are male mating features 32, 34 that fit together with the corresponding female features 22, 24 in the top cap 10 forming an interference fit. As discussed further above, other fastening mechanisms may be utilized in accordance with embodiments of the invention.

The base in the illustrated embodiment includes an electrical ground connection for the embedded transducer, which can be, for example, a soldered connection of the ground braid of a coaxial cable (e.g., an outer braid layer in many typical coaxial cables).

In several embodiments, a ground braid of a coaxial cable is pre-soldered to base. When the base is assembled together with the top cap, the inner wire of the coaxial cable is positioned to mate with the piezoelectric transducer as the base is inserted into the "U" area of the top cap. For example, the inner wire can be started with 45 degree bend in the wire and pushing the base into the top cap causes the wire to further bend into place and contact the transducer in the top cap. Epoxy (conductive or not) on the positive lead of the transducer can be positioned to capture the inner wire of coaxial cable.

The improvements discussed herein provide for reliability and consistency and ease of assembly.

Figure 4:
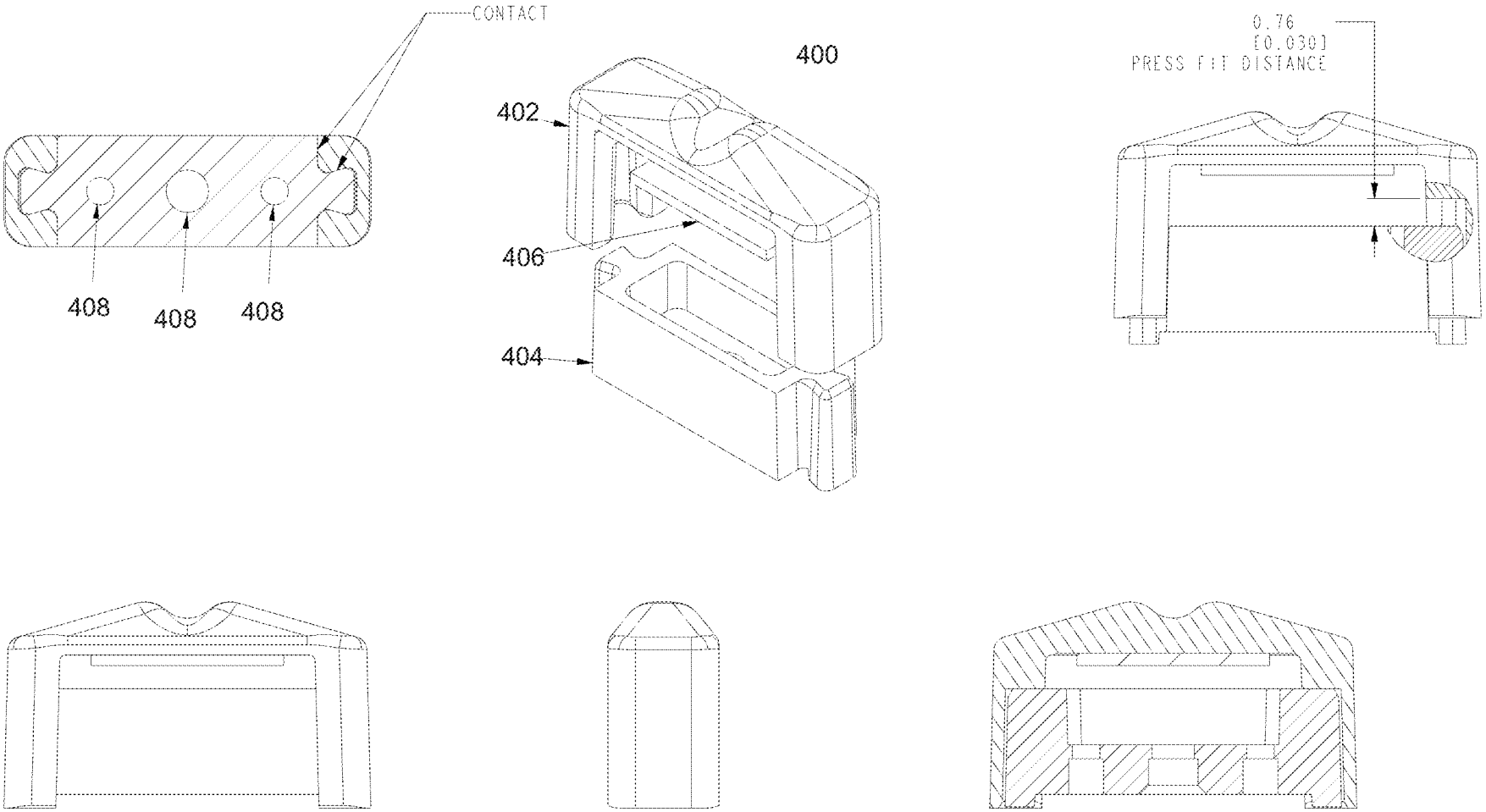
FIG. 4 illustrates views of a pickup saddle with interference fit in accordance with an embodiment of the invention.

Another pickup saddle in accordance with several embodiments of the invention is illustrated in FIG. 4. Similar to the one discussed above, the pickup saddle 400 includes a top cap 402, a base 404, and a piezoelectric transducer 406 placed in between the top surface of the base 404 and an inside surface of the top cap 402. The pickup saddle 400 can also include one or more through holes 408. A lead or wire(positive) connected from the piezoelectric transducer may exit the interior of the top cap 402 and base 404 assembly, when they are joined, through the one or more through holes 408. The positive and ground connections from the transducer can be connected to an amplification circuit or other signal circuit as may be appropriate to a particular application.

Figure 5:
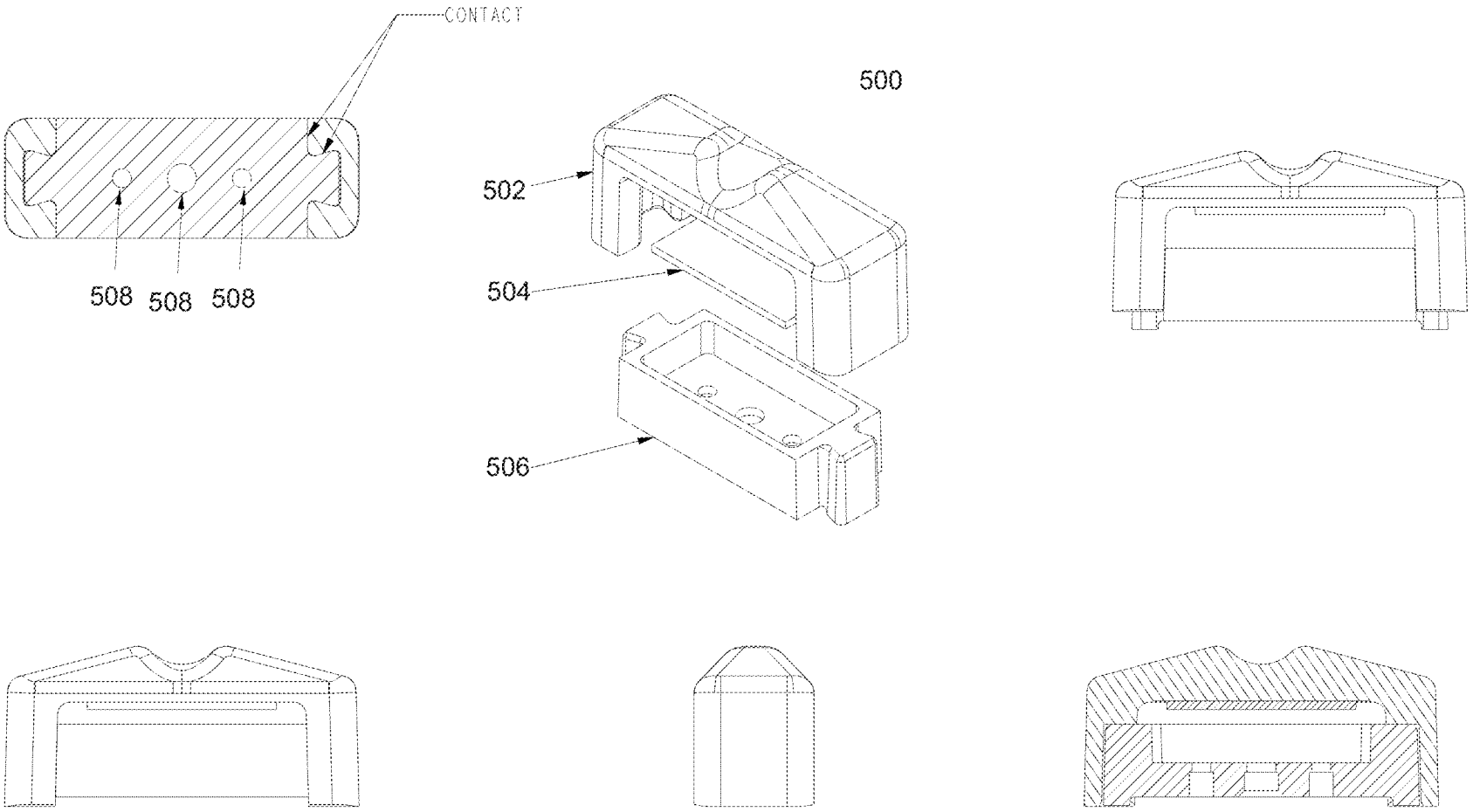
FIG. 5 illustrates views of a pickup saddle with interference fit for stringed bass in accordance with an embodiment of the invention.

Yet another pickup saddle in accordance with some embodiments of the invention is illustrated in FIG. 5. The pickup saddle may be adapted to suit characteristics of a particular stringed instrument, such as, but not limited to, string gauge, bridge size, and/or string tension. Therefore, dimensions (such as height, width, depth) and shape of the pickup saddle may vary. The illustrated pickup saddle 500 may be suitable for a stringed bass. Accordingly, it may be shorter in heighted but thicker in depth than one for a guitar. Similar to those discussed above, the pickup saddle 500 includes a top cap 502, a base 506, and a piezoelectric transducer 504 placed in between the top surface of the base 506 and an inside surface of the top cap 502. The pickup saddle 500 can also include one or more through holes 508. One or more leads or wires (e.g., positive and ground) connected from the piezoelectric transducer may exit the interior of the top cap 502 and base 506 assembly, when they are joined, through the one or more through holes 508.

In order to properly function as a pickup, at least the portions of the surfaces of the top cap and base surrounding the piezoelectric transducer (if not the entire surfaces) should be electrically conductive. In many embodiments, the top cap and base are at least partially formed of electrically conductive material. The resting surface for the string can be of another material, conductive or non-conductive. Although specific configurations of a pickup saddles are described above with respect to FIG. 2A-5, one skilled in the art will recognize that any of a variety of configurations may be utilized in accordance with embodiments of the invention as may be suitable for a particular application.

Additional Embodiments

The structures and principles discussed above can be implemented in any of a number of styles of pickup saddles for stringed instruments. Additional styles of pickup saddles often sense vibration and output electrical signals in the same manner, but may be placed in slightly different locations or be mounted or fastened in a different way to the instrument.

Tune-o-Matic Bridge

Pickups in accordance with embodiments of the invention can be implemented in a style of bridge and saddle system referred to as tune-o-matic bridges. Tune-o-matic bridges are most often, but not exclusively, used on electric guitars. They usually do not incorporate pickups and the pickups are mounted to another part of the guitar body under the strings, although pickups can be built into the saddles as will be discussed below.

Figure 6:
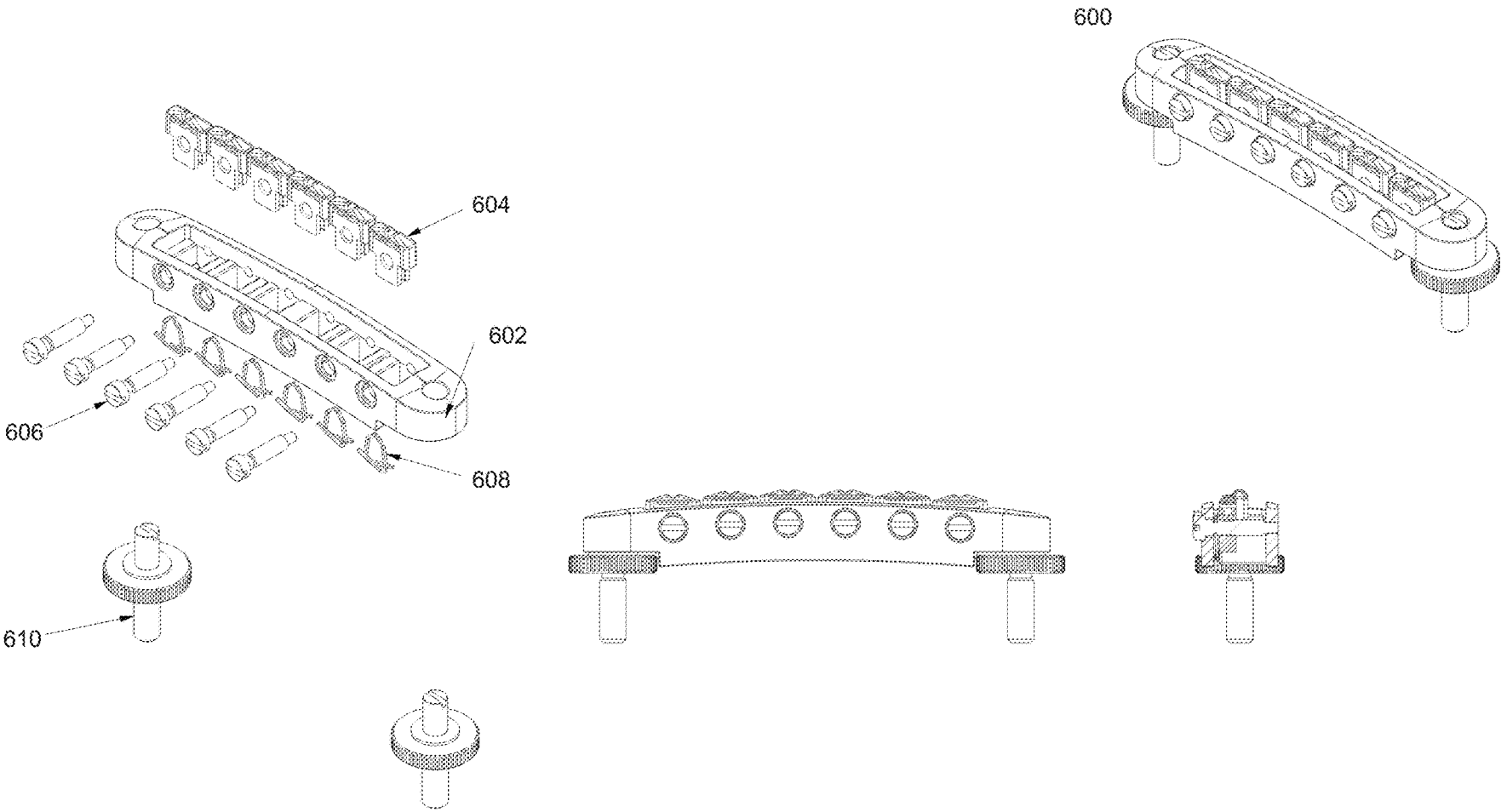
FIG. 6 illustrates a tune-o-matic style bridge with pickup saddles in accordance with embodiments of the invention.

In additional embodiments of the invention, pickup saddle utilizing interference fit may be utilized in a tune-o-matic type bridge. One embodiment is illustrated in FIG. 6. A tune-o-matic bridge 600 includes an oblong saddle 602 (or bridge) which holds six saddle inserts 604 and corresponding string length (intonation) adjustment screws 606. Some embodiments also include springs or spring clips 608 to keep the adjustment screws in place. Other numbers of saddle inserts may be appropriate as suitable to a particular instrument and its number of strings. It can be mounted to a guitar via two threaded posts 610 that screw directly into a guitar's solid body or into threaded anchors that are pressed into the body.

Figure 7:
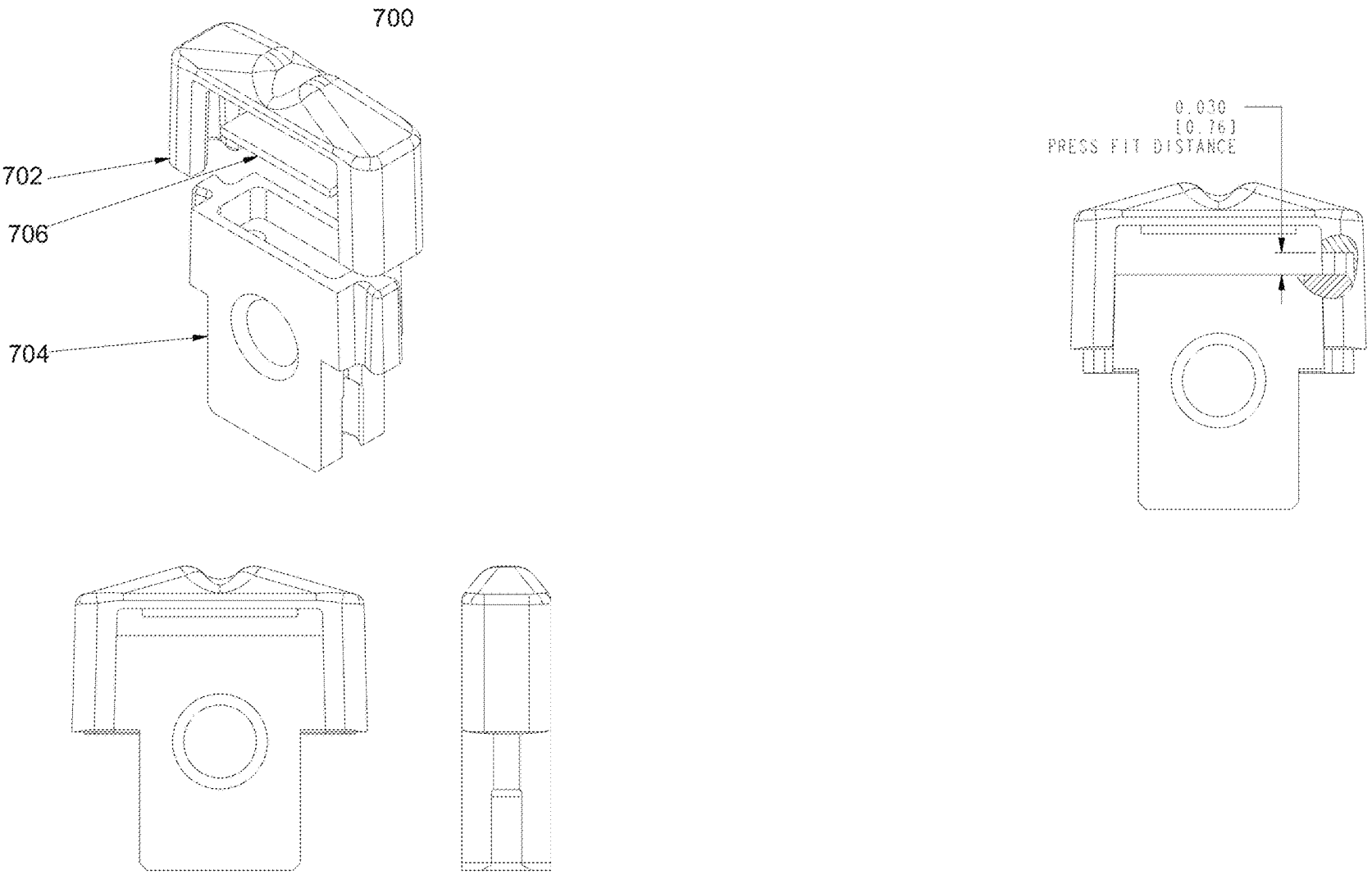
FIG. 7 illustrates a pickup saddle for a tune-o-matic style bridge in accordance with an embodiment of the invention.

The construction of a saddle insert 700 is illustrated in FIG. 7 according to an embodiment of the invention. Similar to the embodiments discussed above, the saddle insert includes a top cap 702, base 704, and piezoelectric transducer 706. The base 704 slides into the top cap 702 and maintains its position by interference fit.

The intonation adjustment screw 606 acts as an opposing force to the string tension pulling the saddle toward the head of the guitar. As the intonation adjustment screw is moved in or out, the corresponding saddle insert can rock forward or backward slightly due to looseness in the threads of the screw. If the bottom surface of the saddle insert is flat, the portion of the surface in contact with the bridge can shift from the front edge (toward the head of the guitar) to the rear edge (toward the bottom of the guitar). This alternating from one contact edge to the other can shift the intonation drastically.

Figure 8:
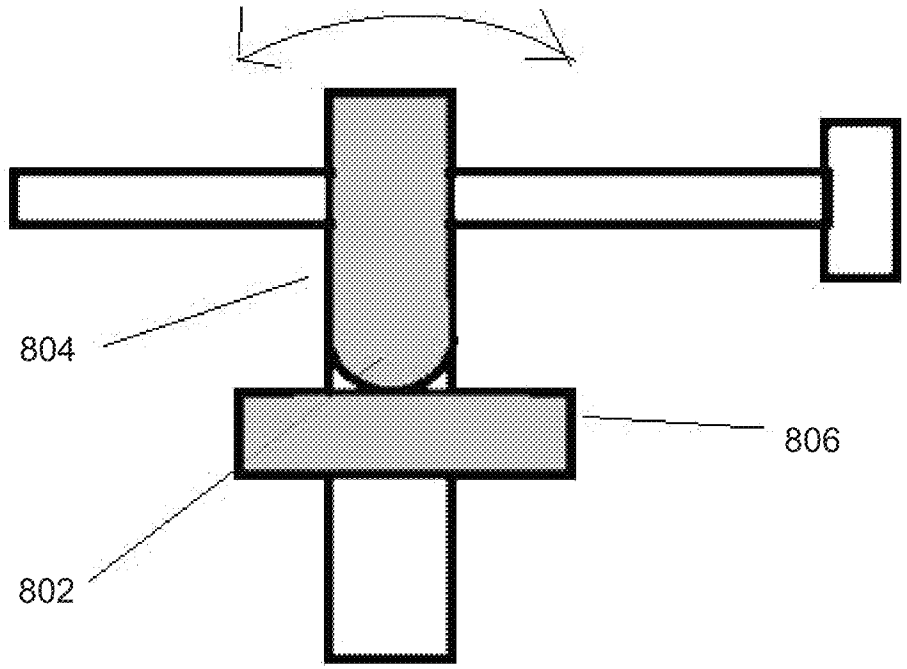
FIG. 8 illustrates a pickup saddle having bottom contouring for a tune-o-matic style bridge in accordance with an embodiment of the invention.

In several embodiments of the invention, the bottom surface 802 of the saddle insert(s) 804 is slightly curved (or convex) front to back as illustrated in FIG. 8. It contacts the bridge 806 on its resting surface within the bridge. In some embodiments, the curvature can be as small as 2 to 3 degrees. In this way, there is no sharp corner on the front or rear of the bottom surface to alternate between if the saddle insert rocks back and forth. Moreover, the contact surface is moved closer to the center of the saddle insert. With the reduced displacement, the string tension imparted through the saddle insert to the bridge is more consistent, that is, varying less than if the contact point shifts from one edge to the other edge or if the contact point is at the edge farther away from the center of the saddle.

Although specific configurations of a tune-o-matic pickup bridges are described above with respect to FIG. 6-8, one skilled in the art will recognize that any of a variety of configurations may be utilized in accordance with embodiments of the invention as may be suitable for a particular application.

Cartridge Pickup

Figure 2A:
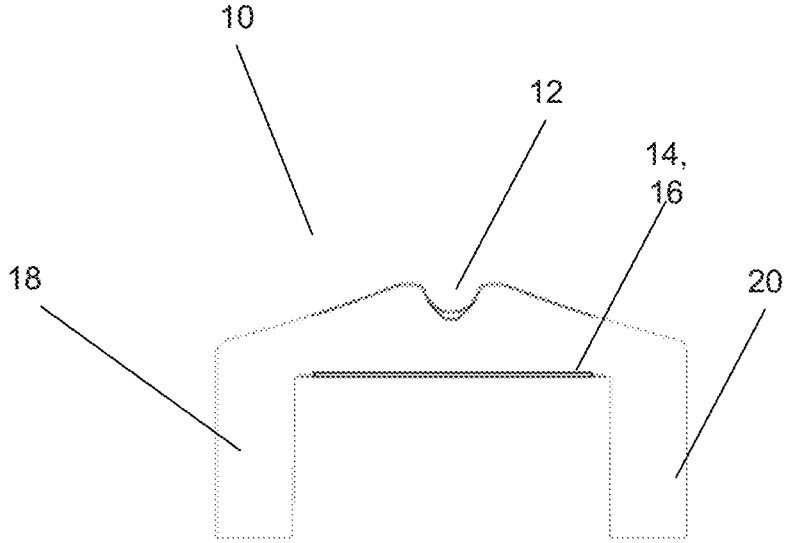
FIG. 2A is a side view diagram illustrating a top cap of a pickup saddle with interference fit in accordance with an embodiment of the invention.
Figure 2B:
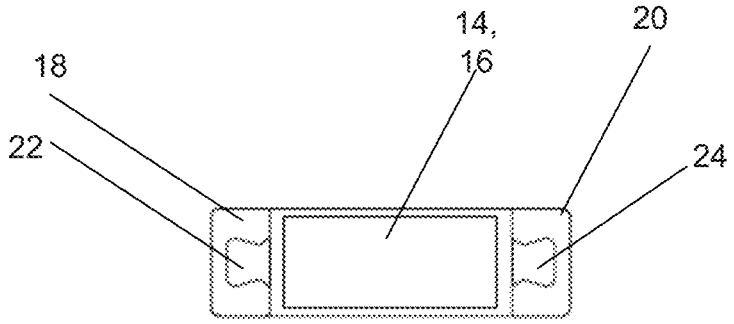
FIG. 2B is a bottom view diagram illustrating a top cap of a pickup saddle with interference fit in accordance with an embodiment of the invention.
Figure 9:
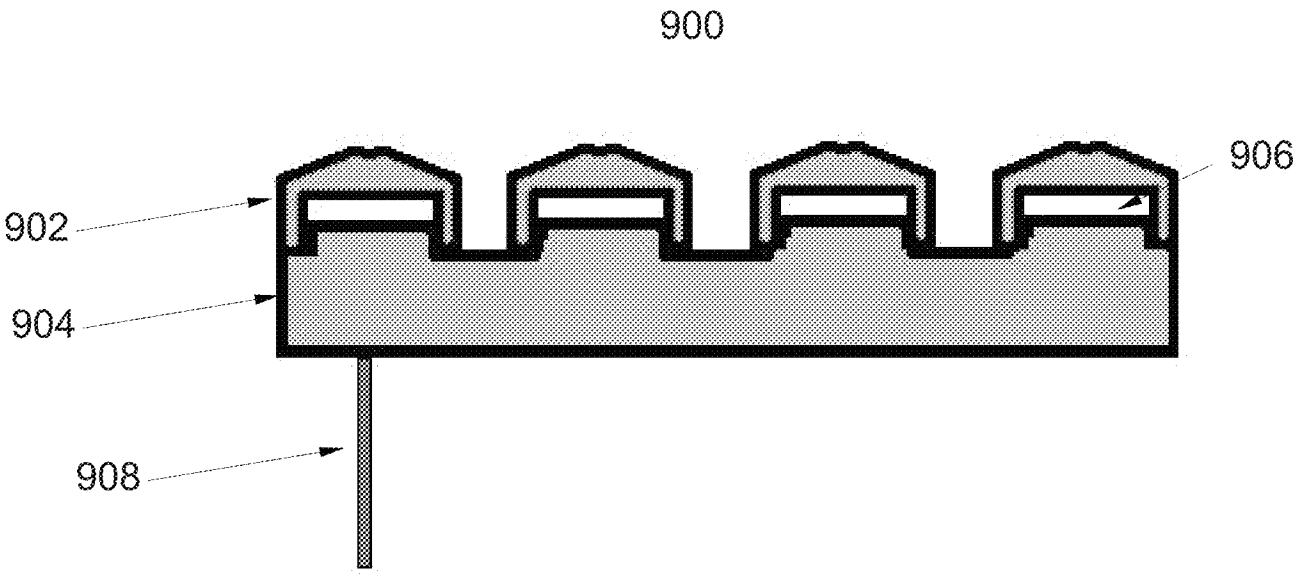
FIG. 9 illustrates a cartridge pickup in accordance with an embodiment of the invention.

In additional embodiments of the invention, multiple top caps, such as that illustrated in FIGS. 2A and 2B, can share a single base. The structure of one such cartridge pickup in accordance with an embodiment of the invention is illustrated in FIG. 9. The cartridge pickup 900 includes one or more top caps 902 where each top cap is fitted onto a common base 904. Each top cap 902 is placed over a piezoelectric transducer 906 between the top cap and the base 904. A common ground wire 908 exits the base. Multiple positive wires from the transducers may be utilized individually or connected in parallel. Although a specific configuration of a cartridge pickup is described above with respect to FIG. 9, one skilled in the art will recognize that any of a variety of configurations may be utilized in accordance with embodiments of the invention as may be suitable for a particular application.

RMC Pickup

In further embodiments of the invention, an RMC style pickup may utilize interference fit per the principles discussed further above. As opposed to the other configurations discussed above, a traditional RMC style pickup has prongs on the base that reach over and capture the ends of the top cap, as in the McClish patent. The prongs in a traditional RMC style pickup are typically crimped and over time can fail as previously discussed.

Figure 10:
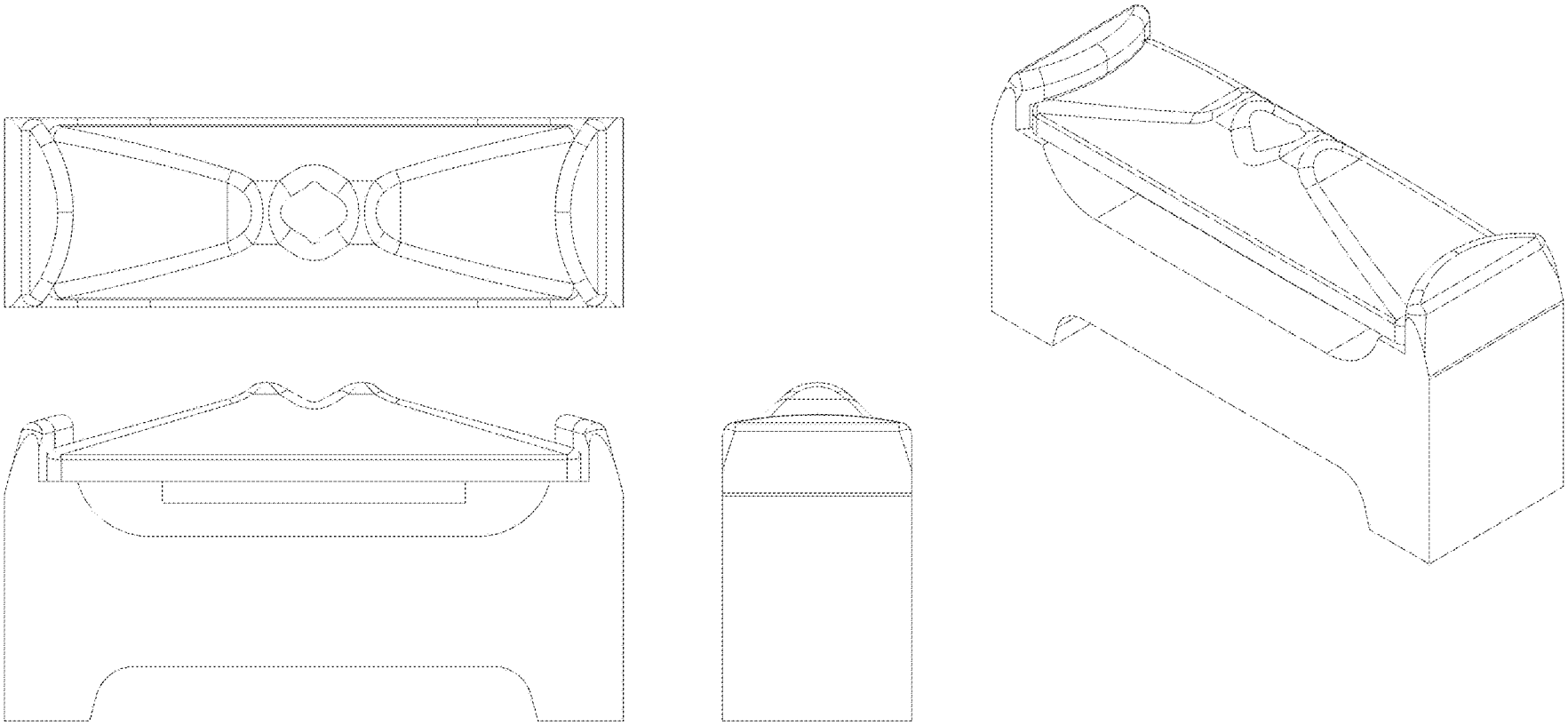
FIG. 10 illustrates an RMC style pickup saddle in accordance with an embodiment of the invention.

An RMC style pickup in accordance with an embodiment of the invention is illustrated in FIG. 10. In the illustrated embodiment, instead of crimping the prongs of the base over the top cap, the prongs utilize interference fit to secure the top cap, i.e., by friction of the interference fit. In this way, less preload is placed on the top cap.

While the above description contains many specific embodiments of the invention, these should not be construed as limitations on the scope of the invention, but rather as an example of one embodiment thereof. Accordingly, the scope of the invention should not be limited to the specific embodiments illustrated.

What is claimed is:

1. A pickup saddle for a stringed instrument, comprising:

a U-shaped top cap having a string resting surface configured for a string to rest on it and two legs, each leg including a receiving portion;

a base fitted to the interior of the top cap, where two surfaces of the base include a mating portion matching with and affixed to a receiving portion of the top cap, each receiving portion and mating portion matching and configured to mate with each other;

a piezoelectric transducer with an upper surface mechanically and electrically connected to the top cap and with a lower surface not directly in contact with the top cap and the base;

a positive wire connected to the lower surface of the piezoelectric transducer; and a ground wire connected to the base.

2. The pickup saddle of claim 1, wherein the receiving portion of each leg of the top cap includes a receiving cavity for an interference fit and where each mating portion of the base includes a protrusion for an interference fit formed to fit a corresponding receiving cavity on the top cap.

3. The pickup saddle of claim 2, wherein the interference fits are dovetail joints.

4. The pickup saddle of claim 3, wherein the dovetail joint is tapered toward the top of the pickup saddle.

5. The pickup saddle of claim 1, further comprising a bridge that includes the pickup saddle as a pickup saddle insert and at least one other pickup saddle insert within the bridge, where each saddle insert includes a corresponding intonation adjustment screw.

6. The pickup saddle of claim 1, wherein the bottom surface of the base is convex shaped front-to-back.

7. The pickup saddle of claim 1, further comprising at least one additional top cap attached to the base and a piezoelectric transducer under each additional top cap.

8. The pickup saddle of claim 1, wherein the ground wire is connected to the base by solder.

9. The pickup saddle of claim 1, wherein the piezoelectric transducer is affixed to the underside of the top cap and connected to a positive wire facing downward from the top cap.

10. The pickup saddle of claim 9, wherein the positive wire passes through a hole in the base and exits the underside of the base.

* * * * *